US007392730B2

(12) United States Patent
Kim et al.

(10) Patent No.: US 7,392,730 B2
(45) Date of Patent: Jul. 1, 2008

(54) ROTARY PUNCHING APPARATUS

(76) Inventors: Ok-Hwan Kim, #907-603 Hugok LG Apt., Ilsan-3-dong, Goyang City, Gyeonggi-do 411-734 (KR); Sang-Ho Lee, #411 Sungchang Building, 66-2, Shinheung-2-dong, Soojung-ku, Sungnam City, Kyungkido 461-808 (KR)

( * ) Notice: Subject to any disclaimer, the term of this patent is extended or adjusted under 35 U.S.C. 154(b) by 178 days.

(21) Appl. No.: 11/334,815

(22) Filed: Jan. 18, 2006

(65) Prior Publication Data

US 2007/0007327 A1 Jan. 11, 2007

(30) Foreign Application Priority Data

Jul. 11, 2005 (KR) ..... 10-2005-0062343
Oct. 20, 2005 (KR) ..... 10-2005-0099012
Oct. 20, 2005 (KR) ..... 10-2005-0099013

(51) Int. Cl.
*B26F 1/04* (2006.01)

(52) U.S. Cl. ..... 83/687; 83/588; 83/627; 83/691

(58) Field of Classification Search ..... 83/620, 83/623, 627, 635, 640, 641, 684, 685, 686, 83/687, 691, 690, 694, 588, 613; 30/358, 30/361, 278, 279.2, 314, 315, 364; 234/109
See application file for complete search history.

(56) References Cited

U.S. PATENT DOCUMENTS

| | | | | | |
|---|---|---|---|---|---|
| 615,677 | A * | 12/1898 | Burton | ..... | 30/358 |
| 854,630 | A * | 5/1907 | Cox et al. | ..... | 30/358 |
| 1,015,356 | A * | 1/1912 | Stone | ..... | 83/620 |
| 1,375,721 | A * | 4/1921 | Nichols | ..... | 83/552 |
| 3,482,311 | A * | 12/1969 | Farris | ..... | 30/358 |
| 5,495,671 | A * | 3/1996 | Shun-Yi | ..... | 30/364 |
| 6,672,191 | B2 * | 1/2004 | Lin | ..... | 83/620 |
| 6,742,431 | B1 * | 6/2004 | Oh | ..... | 83/687 |
| 6,752,058 | B2 | 6/2004 | Oh | | |

* cited by examiner

*Primary Examiner*—Stephen Choi
(74) *Attorney, Agent, or Firm*—Daly, Crowley, Mofford & Durkee, LLP

(57) ABSTRACT

A rotary punching apparatus includes: an upper rotation plate provided with punching member on which punching blade having a pattern of a specific shape is formed, and an upper jig which support elastically the punching member and forms a guide hole in the same shape as the pattern; an upper plate configured to enable the upper rotation plate to be rotated; a lower rotation plate including lower jig on which a punching hole in the same shape as the pattern is formed; and lower plate configured to enable the lower rotation plate to be rotated.

3 Claims, 12 Drawing Sheets

ROTARY PUNCHING APPARATUS

CROSS REFERENCE TO RELATED APPLICATION

The present application claims priority to Korean Patent Application No. 10-2005-0062343 filed on Jul. 11, 2005, Korean Patent Application No. 10-2005-0099012 filed on Oct. 20, 20005 and Korean Patent Application No. 10-2005-0099013 filed on Oct. 20, 20005, all of which are incorporated herein by reference.

BACKGROUND

1. Field of the Invention

Example embodiments of the present invention relates in general to the field of a rotary punching apparatus, and more specifically to a rotary punching apparatus which can perform punching on a desired position without regard to the punching position on a sheet which becomes an object of punching and simultaneously enable a shape on the sheet to have the continuity and a uniformly punched surface.

2. Description of the Related Art

In general, a punching apparatus is an apparatus for punching a predetermined part such as pictures, cards, letter papers and the like (hereinafter referred to as "sheet") and can perform punching in a simple circular shape so as to keep papers and exhibit an aesthetic sense to the sheet by punching the sheet in various shapes such as flower patterns for decoration.

A conventional punching apparatus will be concretely explained with reference to FIG. 1, the conventional punching apparatus includes a punching member 101 provided with a punching blade having a pattern of a specific shape, an upper jig 111 having a guide hole 112 which the punching blade is penetrated, a lower jig 113 having a punching hole 114 which the punching blade is also penetrated, and a base 121 configured to support the lower jig 113. Further, since the punching is performed only when the punching blade 102 of the punching member 101, the guide hole 112 and the punching hole 114 are accurately aligned in a straight line, ends of the upper jig 111 and the lower jig 113 are formed in a form of "⊏" in a body by a coupling part 115. Thus, a fixed aperture is formed between the upper jig 111 and the lower jig 113, and the aperture is constructed so as to insert a sheet to be punched into the aperture.

According to the operation of the conventional punching apparatus as described above, the sheet is punched in the same pattern as the punching blade 102 by inserting the sheet to be punched into the aperture between the upper jig 111 and the lower jig 113 and giving pressure to the punching member 101 downward.

However, when the sheet is inserted into the conventional punching apparatus as described above, the sheet cannot be inserted by passing through the coupling part 115. Accordingly, because the insertion of the sheet is limited by the coupling part 115, it has a problem that the punching position of the sheet is limited and punched to a boundary.

Further, it has a problem that a surface of the punched sheet is uneven, in case of punching the sheet by the punching blade and the punching hole, even though the upper jig and the lower jig are aligned by the coupling part.

SUMMARY

Accordingly, the present invention is provided to substantially obviate one or more problems due to limitations and disadvantages of the related art.

Example embodiments of the present invention provide a rotary punching apparatus configured to freely punch on a desired position without regard to the punched position on a sheet as an object of a punching process, and enable a shape on the sheet to have the continuity.

In some example embodiments, a rotary punching apparatus includes: an upper rotation plate having a punching member on which a punching blade having a specific pattern is formed and an upper jig configured to elastically support the punching member and form a guide hole in the same shape as the pattern; an upper plate configure to enable the upper rotation plate to be rotated; a lower rotation plate including a lower jig on which a punching hole is formed in the same shape as the pattern; and a lower plate configured to enable the lower rotation plate to be rotated. The upper and the lower plate are provided with at least one or more magnets in a position opposite to each other, and the upper and the lower rotation plate are provided with at least one magnets in a position opposite to each other, thereby being aligned in fixed positions to each other by the magnetic force of the magnets.

In the rotary punching apparatus according to the present invention, the upper and the lower rotation plate further include at least one rotation units which are rotated and coupled with the upper and the lower plate, and the rotation units may be one of a ball bearing or a roller bearing.

The upper and the lower jig may be attached and detached to the upper and the lower plate.

Preferably, the upper and the lower jig may be one of a semi-circular shape and a fan shape, and the upper and the lower plate further include one or more guide units inner side thereof.

The guide units may be composed of an elastic piece and include a fixing body, an elastic body configured to press the fixing body, and a fixing plate configured to enable the elastic body to be seated and fixed.

The upper and the lower rotation plate further include at least one fixing grooves which are engaged with the guide units along an external surface.

In other example embodiments, a rotary punching apparatus according to the present invention includes: an upper rotation plate provided with a punching member on which a punching blade having a specific pattern is formed and an upper jig which supports elastically the punching member and forms a guide hole in the same shape as the pattern; an upper plate configured to enable the upper rotation plate to be rotated; a lower rotation plate including a lower jig on which a punching hole in the same shape as the pattern is formed; a lower plate configured to enable the lower rotation plate to be rotated; and at least one magnets provided in a position which the upper and the lower plate, the upper and the lower rotation plate are respectively opposite to each other. After setting the position by the magnets, the position is aligned to each other by a position correction unit.

The position correction unit further includes a position correction member and a groove opposite to the position correction unit. The groove is located on the upper rotation plate, and the position correction member is located on the lower rotation plate. The groove is located on the lower rotation plate, and the position correction member may be located on the upper rotation plate.

Further, the groove is formed in a sunk hemisphere shape, and a magnet is further included in a vertical line of the groove.

Further, the position correction member is composed of magnets, and the guide blade is formed smaller than a punched surface punched by the punching blade.

In still other example embodiments, a rotary punching apparatus includes: an upper rotation plate having a punching member on which a punching blade having a specific pattern is formed, at least one light projection plates, and an upper jig which elastically supports the punching member and forms a guide hole in the same shape as the pattern; an upper plate configured to enable the upper rotation plate to be rotated; a lower rotation plate including a light unit which transmits light on the light projection plate and a lower jig on which a punching hole in the same shape as the pattern is formed; and a lower plate provided configured to enable the lower rotation plate to be rotated.

The light generated from the light unit is projected on the light projection plate and aligned to a fixed position to each other.

Preferably, the light projection plate and the light unit may be aligned to each other by providing a crisscross form which is formed by enabling two lines to be respectively crossed.

Preferably, the upper and the lower plate, and the upper and the lower rotation plate further include at least one magnets in a position respectively opposite to each other.

BRIEF DESCRIPTION OF THE DRAWINGS

Example embodiments of the present invention will become more apparent by describing in detail example embodiments of the present invention with reference to the accompanying drawings, in which.

DESCRIPTION OF EXAMPLE EMBODIMENTS OF THE PRESENT INVENTION

Figure 1:
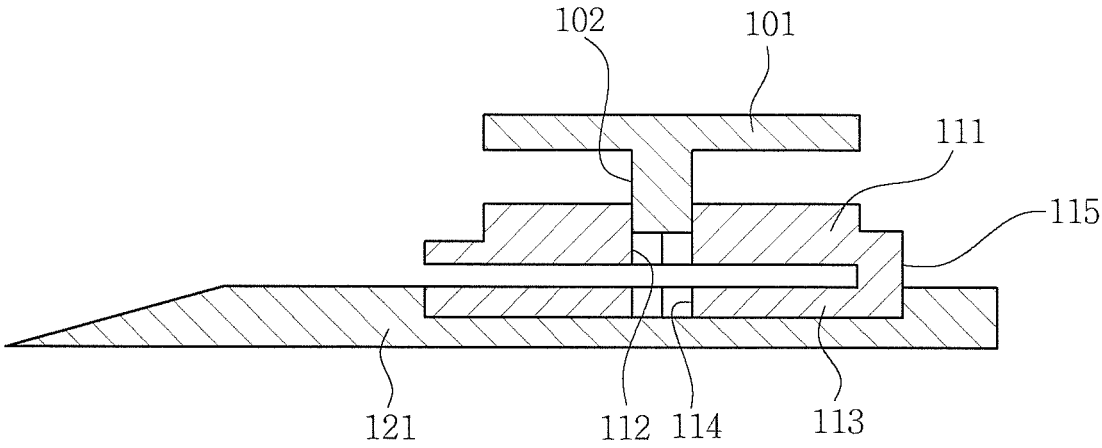
FIG.1 PRIOR ART
FIG. 1 is a cross-sectional view illustrating a conventional punching apparatus.

Example embodiments of the present invention are disclosed herein. However, specific structural and functional details disclosed herein are merely representative for purposes of describing example embodiments of the present invention, however, example embodiments of the present invention may be embodied in many alternate forms and should not be construed as limited to example embodiments of the present invention set forth herein.

Accordingly, while the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention. Like numbers refer to like elements throughout the description of the figures.

Hereinafter, preferred embodiments of the present invention will be described in detail with reference to the accompanying drawings. The embodiment will be explained in detail for enabling people who have common intellects in a corresponding field to execute the present invention.

Figure 2:
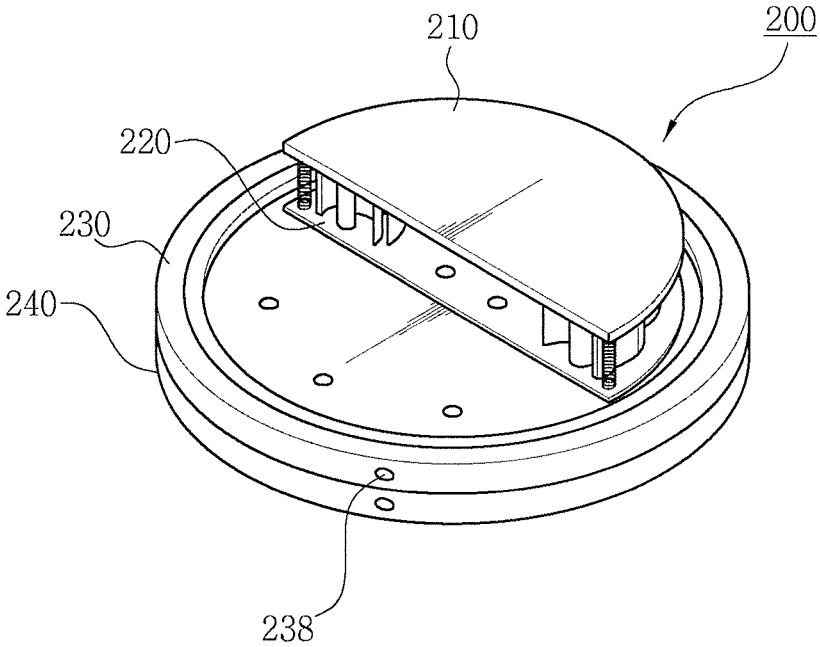
FIG. 2 is a perspective view illustrating a first example embodiment of a rotary punching apparatus according to a first embodiment of the present invention.
Figure 3:
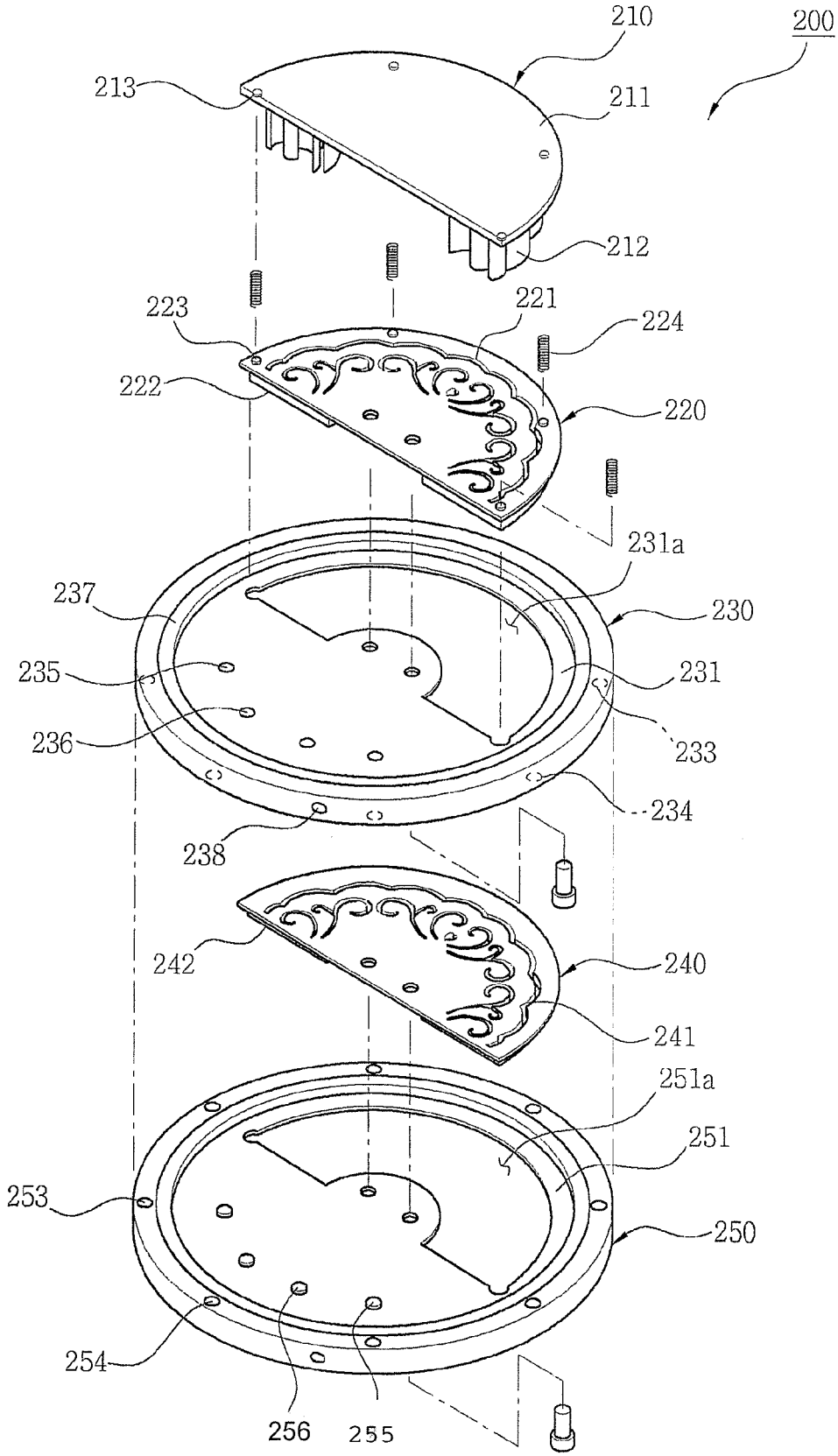
FIG. 3 is an exploded perspective view illustrating the rotary punching apparatus illustrated in FIG. 2.
Figure 4:
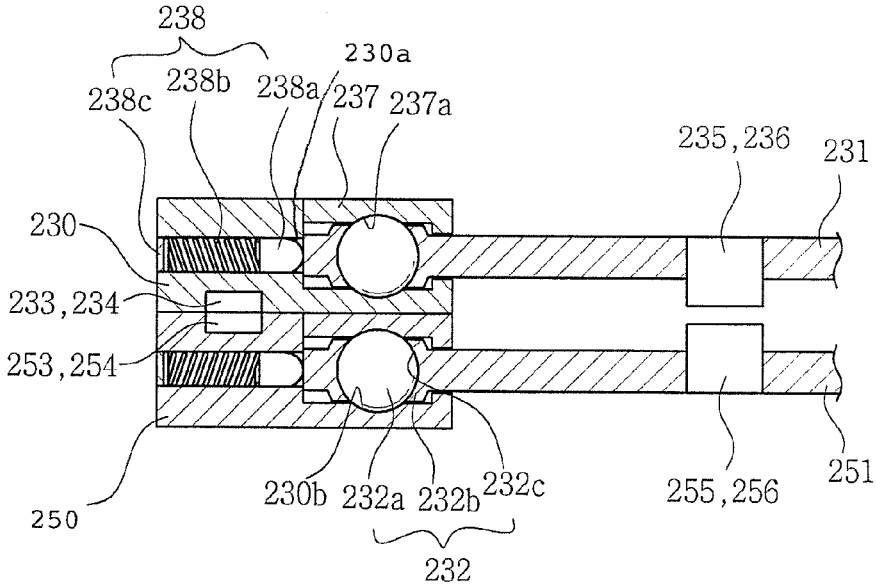
FIG. 4 is a partial expanded and cross-sectional view illustrating a guide unit of the rotary punching apparatus illustrated in FIG. 2.
Figure 5:
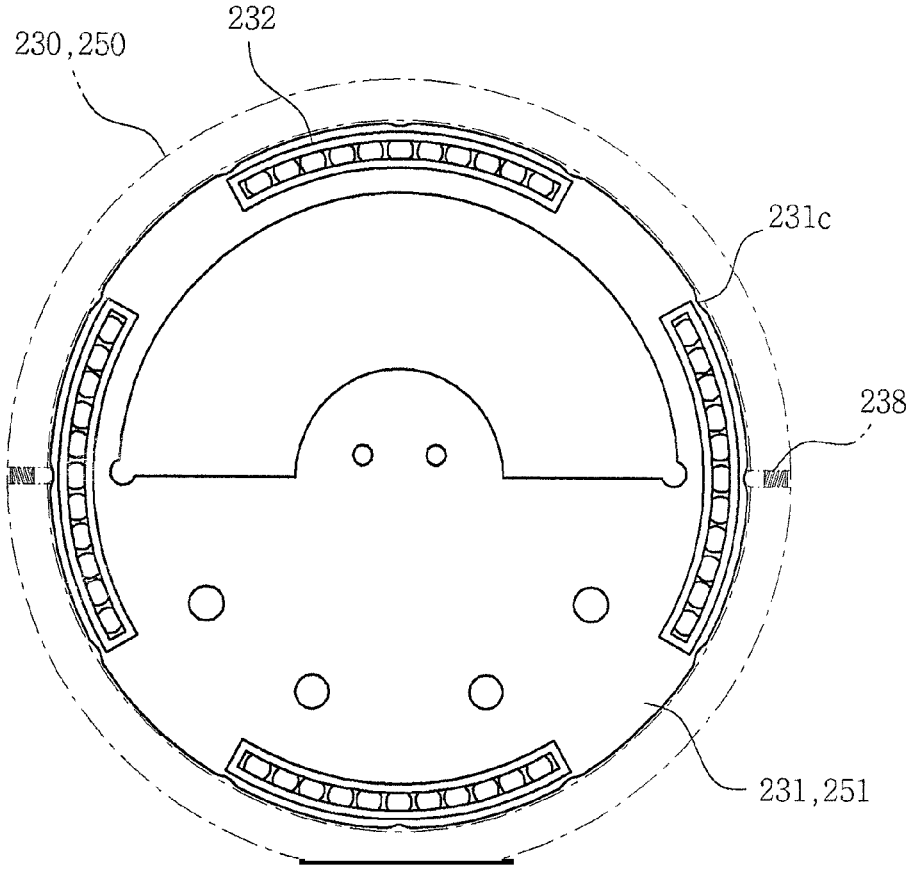
FIG. 5 is a plan view illustrating a rotation plate illustrated in FIG. 2.

FIG. 2 is a perspective view illustrating a first example embodiment of a rotary punching apparatus according to a first embodiment of the present invention, FIG. 3 is an exploded perspective view illustrating the rotary punching apparatus illustrated in FIG. 2, FIG. 4 is a partial expanded and cross-sectional view illustrating a guide unit of the rotary punching apparatus illustrated in FIG. 2, and FIG. 5 is a plan view illustrating a rotation plate illustrated in FIG. 2.

As illustrated in FIGS. 2 to 5, the rotary punching apparatus 200 includes a punching member 210, an upper jig 220, an upper plate 230, a lower jig 240 and a lower plate 250.

The punching member 210 protrudes and forms a pressurization plate 211 having a semi-circular shape in a form of a thin plate, a punching blade 212 which directs downwardly in a lower end of the pressurization plate 211 and has a pattern of a specific shape, and a spring holder 213 in a hemisphere shape at a regular interval in a position which an interference with the punching blade 212 is not generated in a lower end of the pressurization plate 211.

The upper jig 220 penetrates and forms a guide hole 221 having the pattern of the specific shape opposite to the punching blade 212 inside and couples a spring 224 between the spring holders 213 and 223 by locating a spring holder 213 opposite to the spring holder 213 of the punching member 210, without being interfered with the guide hole 221. As a result, the upper jig 220 may support elastically the punching member 210, and insert and fix a seating plate 222 into a seating hole 231*a* of an upper rotation plate 231 by protruding a seating plate 222 in a lower end of the upper jig 220.

The upper plate 230 is formed in a cylinder shape, is provided with two insertion holes 230*a*, which penetrate a side of the upper plate 230, in a position symmetrical to each other, and enables a guide unit 238 to be inserted and fixed to inside of the insertion hole 230*a*. The upper plate 230 is seated on a guide groove 230*b* by forming the guide grove 230*b* centered in a circumference inside thereof, and provided with the upper rotation plate 231 fixed and coupled with the upper plate 230 by a pressurization plate 237. Eight magnets 233 and 234 are fixed and formed on a lower surface of the upper plate 230 at a regular interval.

The magnet 233 having N-polarity and the magnet 234 having S-polarity can form the magnetic force contrary to each other by being crossed and arranged to each other by four.

The guide unit 238 is composed of a fixing body 238*a*, an elastic body 238*b* which elastically supports in an inner direction of the upper plate 230 by supporting elastically the fixing body 238*a*, and a fixing plate 238*c* which enables the elastic body 238*b* to be fixed to the insertion hole 230*a*.

The upper rotation plate 231 penetrates and forms the seating hole 231*a* in a semi-circular shape inside thereof, and is provided with 4 rotation units 232 along a side of an upper surface of the upper rotation plate 231. The upper rotation plate 231 is formed by penetrating a lower surface of the upper rotation plate 231 from an upper surface so as to form 4 magnets 235 and 236 which are respectively crossed and arranged into N-polarity and S-polarity.

Further, the upper rotation plate 231 has 12 fixing grooves 231*c* along the circumference so as to be engaged with the guide unit 238.

The rotation unit 232 is composed of a bearing 232*a*, a support body 232*b* and a guide hole 232*c*, and formed on the upper rotation plate 231. Additionally, the rotation unit 232 enables the upper rotation plate 231 to be rotated along the guide groove 230*b* in a state that the bearing 232*a* is seated to the guide groove 230*b* on the upper plate 230, and prevents the bearing 232*a* from being separated from the upper rotation plate 231 through the support body 232*b* and the guide hole 232*c*.

The bearing 232*a* may selectively use any one of a ball bearing or a roller bearing.

Further, though it isn't illustrated in drawings, according to another example embodiment of the present invention, the upper rotation plate 231 may be rotated along the guide groove 230*b*, by projecting and forming a plurality of hemisphere protrusions (not shown) on an upper and a lower surface of the upper rotation plate 231 and locating the protrusions in the guide groove 230*b*.

The lower jig 240 is provided with a seating plate 242 in the same shape as the upper jig 220 in a lower end. A punching hole 241, which penetrates an upper surface of the lower jig 240, is formed as the same pattern as the punching blade 212.

The lower plate 250 is symmetrically corresponded to the upper plate 230 upward and downward, and the configuration is the same as the upper plate 230.

Further, the lower plate 250 locates 8 magnets 253 and 254 opposite to the magnets 233 and 234, which are located on a lower surface of the upper plate 230, on an upper surface. The S-polarity magnet 253 is located in the N-polarity magnet 233 and the N-polarity magnet 254 is located in the S-polarity magnet 234, thereby enabling the magnets to be aligned in a fixed position due to respective magnetic force.

The lower rotation plate 251 is the same configuration as the upper rotation plate 31 and is located to enable magnets 255 and 256 penetrated and inserted inside thereof to be symmetrical to the magnets 235 and 236 of the upper rotation plate 231. Also, the lower rotation plate 251 enables the magnets 235, 236, 255 and 256 to be aligned in the fixed position due to N-polarity and S-polarity. Accordingly, the upper rotation plate 231 can be engaged with the lower rotation plate 251.

The coupling connection of the present invention will now be explained.

Since the upper plate 230 and the lower plate 250 have the same configuration, the coupling relationship of the upper plate 230 will be only described in detail.

After the magnets 235 and 236 are fixed by crossing and arraying the N-polarity and the S-polarity on the upper rotation plate 231, a plurality of the bearings 232*a* are inserted into the guide hole 232*c* of the upper rotation plate 231.

In case that the bearing 232*a* is inserted so as to be located in the guide groove 230*b* of the upper plate 230, the upper rotation plate 231 is located on the horizontal line with the insertion hole 230*a* of the upper plate 230 and has a shape which the guide unit 238 pressurizes a side of the upper rotation plate 231.

In this state, in case that the pressurization plate 237 is forcibly put and inserted into the upper plate 230, the bearing 232*a* is located between the guide groove 230*b* of the upper plate 230 and the guide groove 236*a* of the pressurization plate 237. Also, the bearing 232*a* may enable the bearing 232*a* to be smoothly slid between the guide grooves 230*b* and 236*a*.

Further, a punching may be performed by inserting and fixing the upper jig 220 to the seating hole 231*a* of the upper rotation plate 231, and the lower jig 240 on the lower rotation plate 251 of the lower plate 250 in the same manner, and enabling patterns of the upper jig 220 and the lower jig 240 to be located on a vertical line.

Further, since the fixing body 238*a* of the guide unit 238 gives pressure to the upper rotation plate 231, the upper rotation plate 231 may be operated at a regular rotation angle by enabling the fixing groove 231*c* to be located in the fixing body 238*a*, when the upper rotation plate 231 is rotated and operated.

Figure 6:
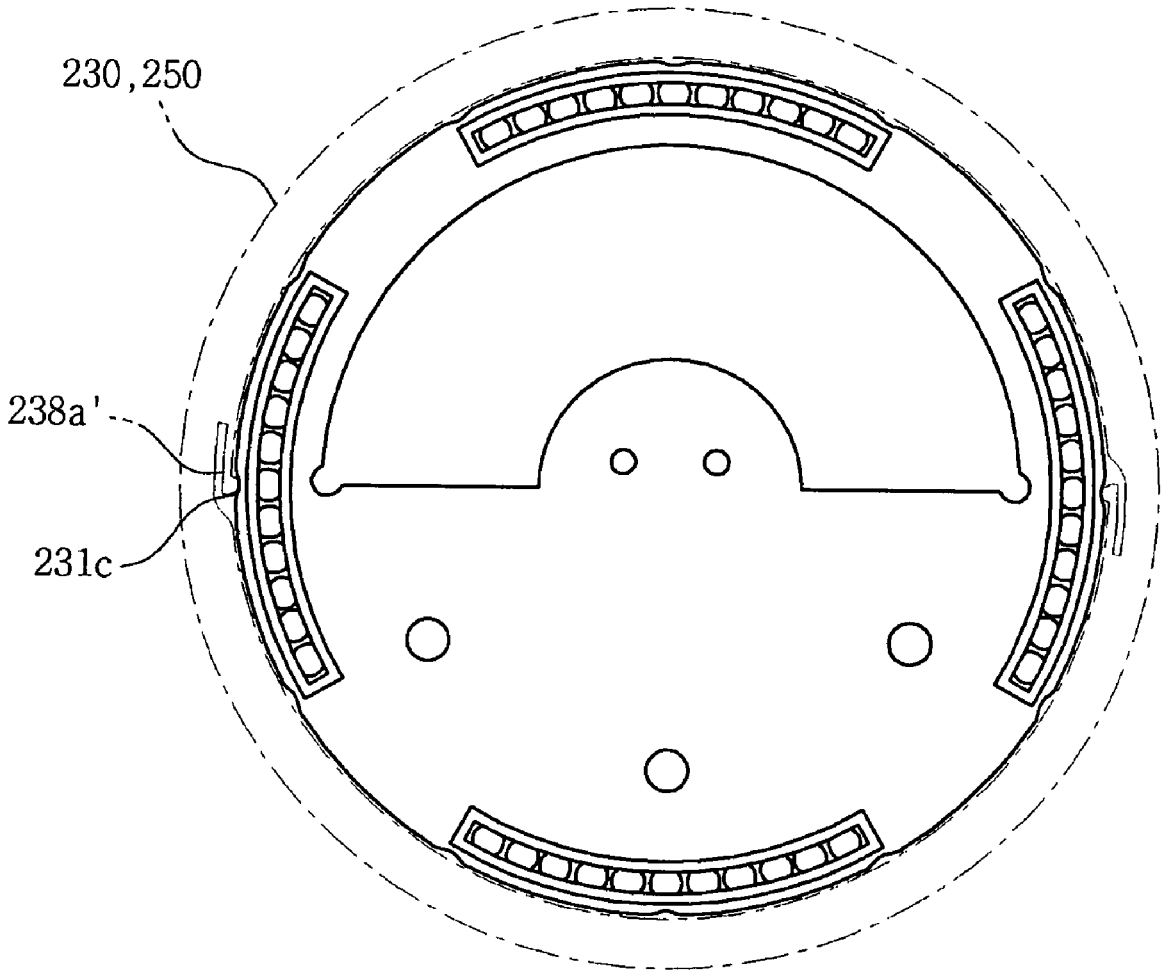
FIG. 6 is a plan view illustrating a rotary punching apparatus according to a second embodiment of the present invention.
Figure 7:
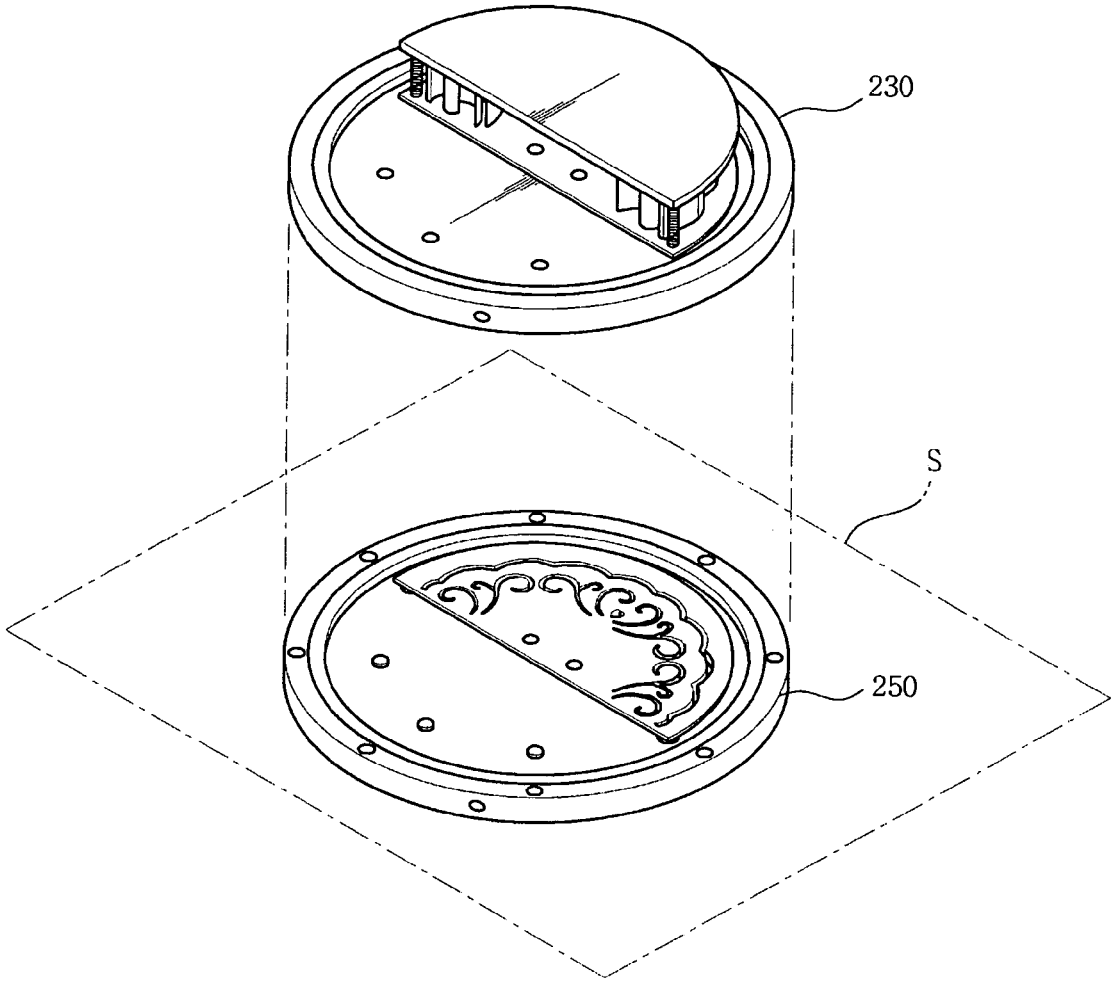
FIG. 7 is a perspective view illustrating an operating state of the first and second embodiment of the rotary punching apparatus according to the present invention.
Figure 8:
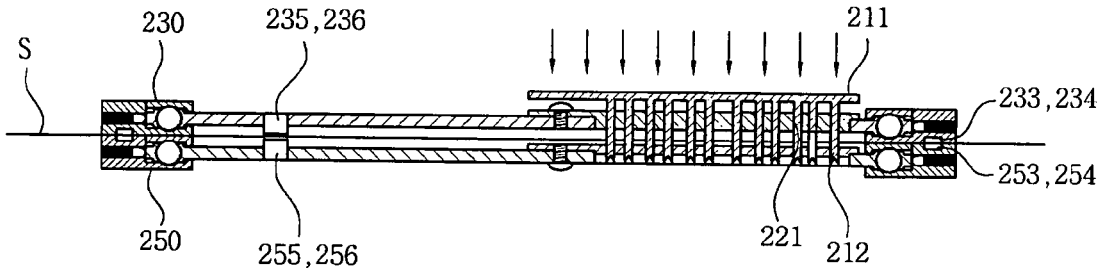
FIG. 8 is a side cross-sectional view illustrating an operating state of the first and the second embodiment of the rotary punching apparatus according to the present invention.
Figure 9:
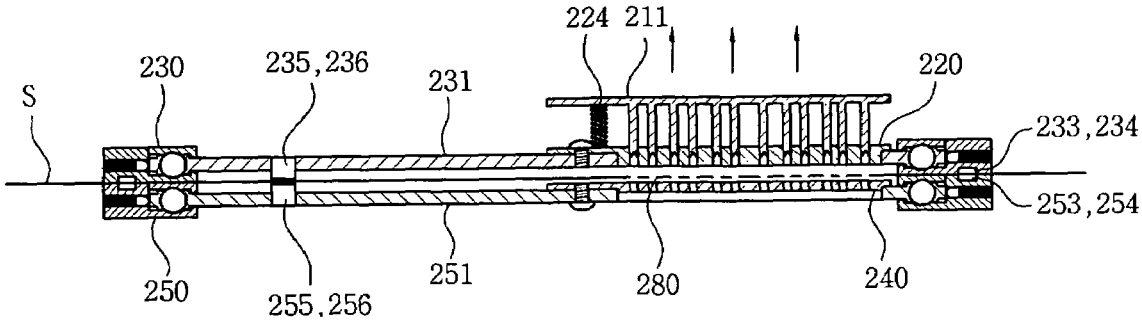
FIG. 9 is a side cross-sectional view illustrating an operating state of the rotary punching apparatus according to the first and second embodiment of the present invention.
Figure 10:
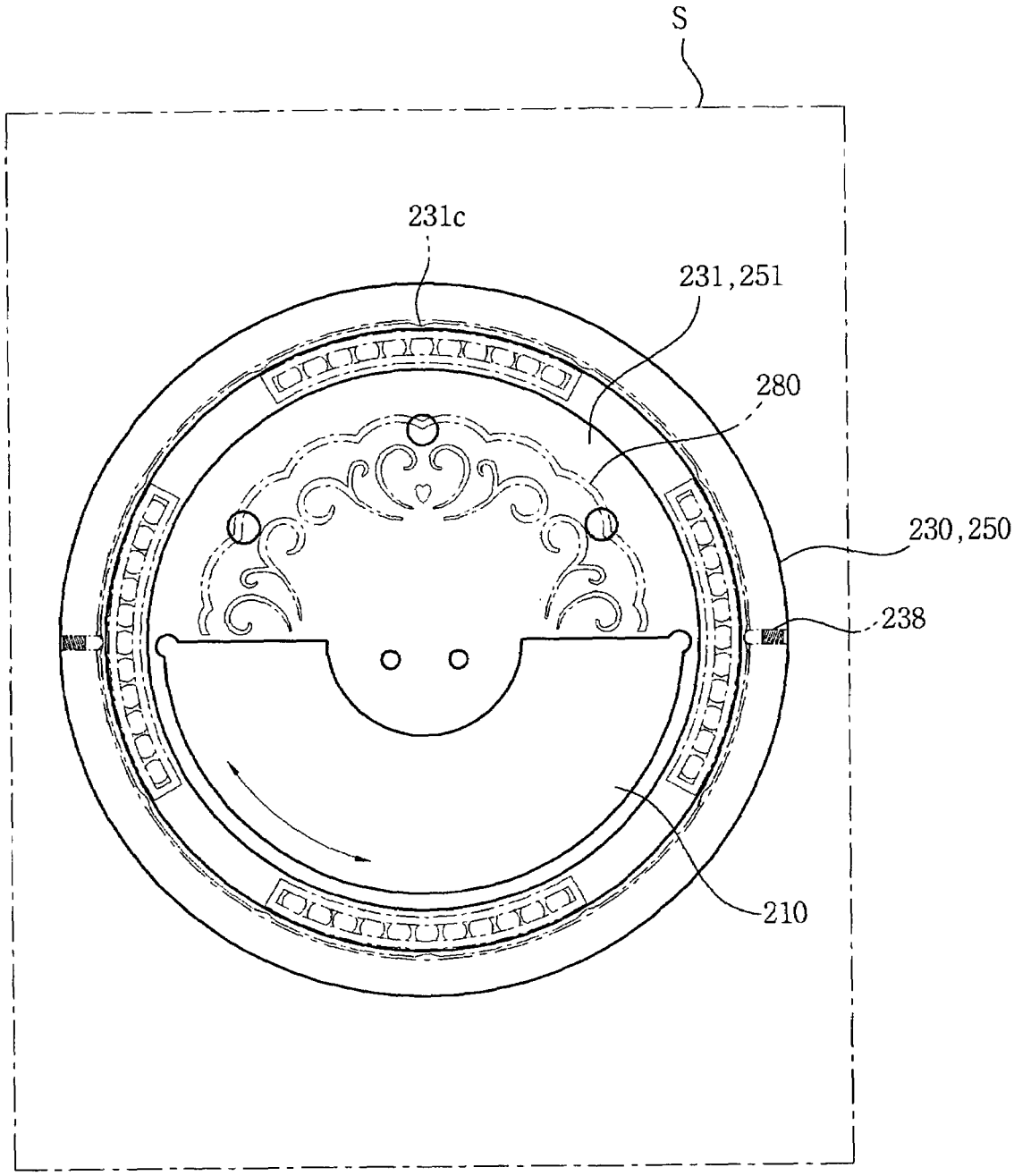
FIG. 10 is a side cross-sectional view illustrating an operating state of the rotary punching apparatus according to the first and second embodiment of the present invention.

FIG. 6 is a plan view illustrating a rotary punching apparatus according to a second embodiment of the present invention.

Referring to FIG. 6, the fixing body 238*a* may be seated to the fixing groove 231*c* of the upper rotation plate 231 through its own elastic restoration force by being composed of an elastic piece 238*a*' which is formed with the upper plate 230 in a body.

Further, though this is not illustrated in drawings, in case that the punching member (not shown) is formed in a fan shape at an angle of 30°~60°, the shape of the upper jig and the lower jig which are engaged with the punching member is also the same shape as the punching member and is attached and detached to/from the seating hole of the rotation plate, so that the pattern of various shapes can be only punched by replacing the upper jig and the lower jig, without replacing the plate.

Hereinafter, an operation state of the rotary punching apparatus according to the present invention will be described in detail with reference to FIGS. 7 to 10.

Referring to FIGS. 7 to 10, after a seat (S) is located between the upper plate 250 and the upper plate 230, the magnets 233 and 234 of the upper plate 230 and magnets 253 and 254 of the lower plate 250 may be located in the same line and aligned to each other. Further, in case that the magnets 235 and 236 of the upper rotation plate 231 and the magnets 255 and 256 of the lower rotation plate 251 are aligned to each other in the same manner, the punching member 210 may be vertically operated upward and downward by enabling the guide hole 221 of the upper jig 220 and the punching hole 241 of the lower jig 240 to be corresponded to each other.

Further, in case that the pressurization plate 211 of the punching member 210 is pressurized, the punching blade 212 moves along the guide hole 221 and a cutting surface is formed by cutting the seat (S). If the pressure of the pressurization plate 211 is removed, the pressurization plate 211 goes upward due to elastic force of the spring 224 and the punching member is restored into the original position. In case of being rotated as much as desired in a restored state, the rotation plates 231 and 251 may be rotated and operated just as much as an angle which the fixing groove 231*c* is formed, and thus punch accurately a pattern of a continuous shape as much as a rotated and operated angle in a desired position or a symmetrical position.

Further, by commonly applying to the upper plate 230 and the lower plate 250, and forming the punching member 210, the upper jig 220 and the lower jig 240 in a body, only the punching member 210, the upper jig 220 and the lower jig 240 are replaced in case that the pattern is replaced into the pattern of the specific shape, thereby being capable of using economically patterns of various shapes.

Figure 11:
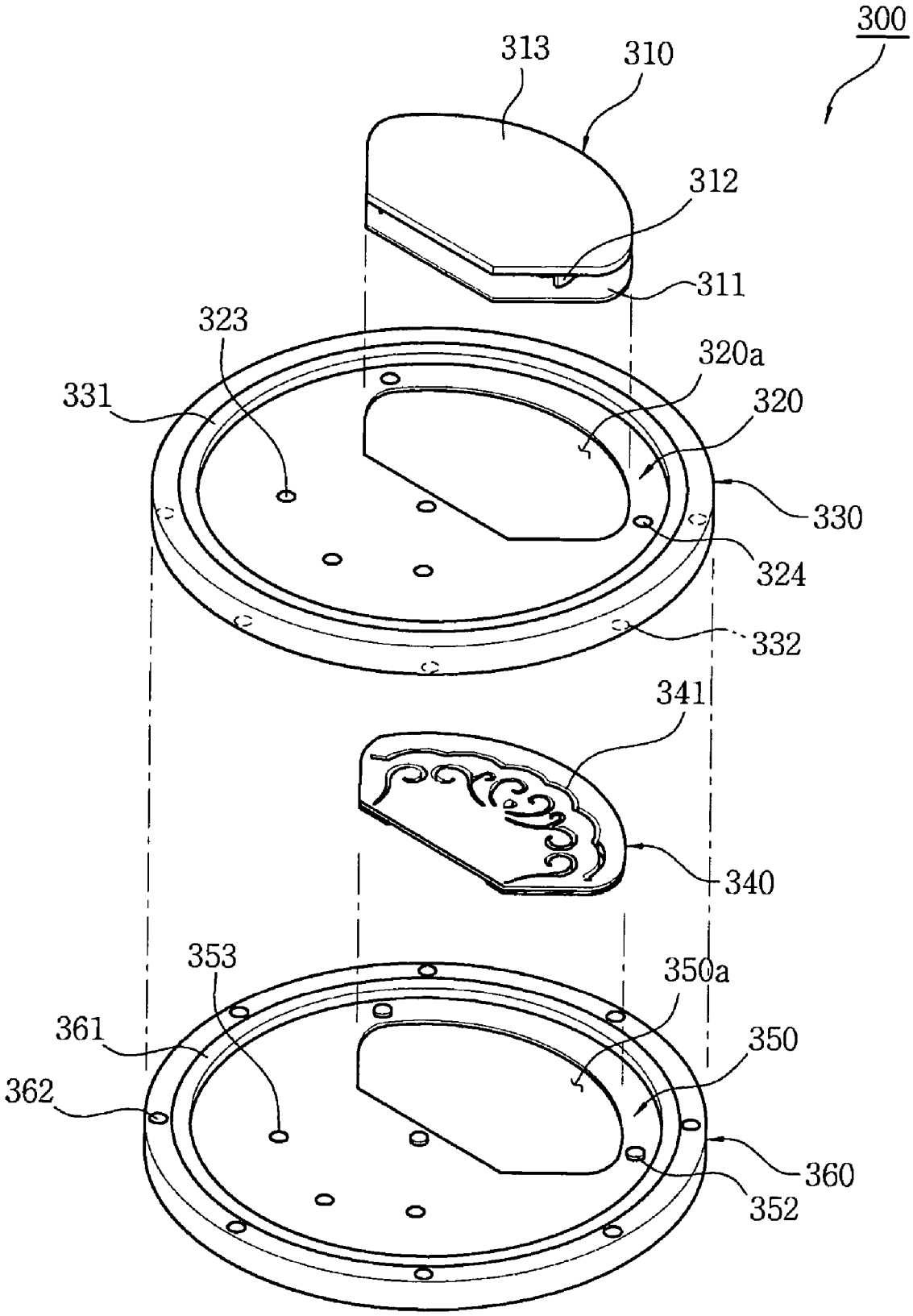
FIG. 11 is an exploded perspective view illustrating the rotary punching apparatus according to a third embodiment of the present invention.
Figure 12:
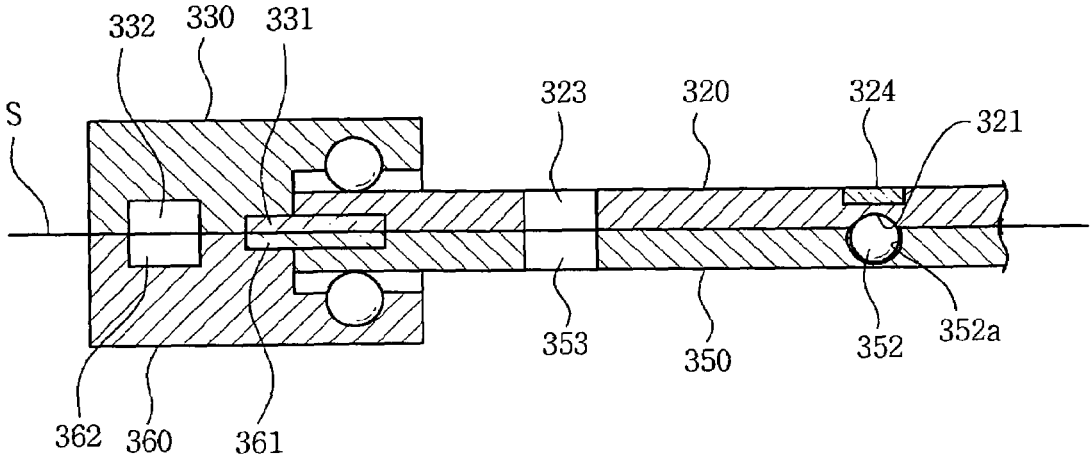
FIG. 12 is a partial expanded cross-sectional view illustrating a position correction member of the rotary punching apparatus illustrated in FIG. 11.

FIG. 11 is an exploded perspective view illustrating the rotary punching apparatus according to a third embodiment of the present invention, and FIG. 12 is a partial expanded cross-sectional view illustrating a position correction member of the rotary punching apparatus illustrated in FIG. 11.

Referring to FIGS. 11 or 12, the punching apparatus 300 is composed of an upper jig 311 on which a specific pattern of a shape is formed, a punching member 310 including a pressurization plate 313 which a punching blade 312 is formed in the same shape as the pattern of the upper jig 311, an upper rotation plate 320 configured to enable the punching member to be coupled, and an upper plate 330 configured to enable the upper rotation plate 320 to be rotated and coupled. Further, the punching apparatus 300 is composed of a lower jig 340 which a punching hole 341 is formed in the same shape as the pattern formed in the punching member 310, a lower rotation plate 350 coupled with the lower jig 340 and the lower plate 360 coupled with a lower rotation plate 350.

The punching member 310 directs downward to the pressurization plate 311 and a lower end of the pressurization plate 311, penetrates and forms the punching blade 312 having the pattern of the specific shape, and is coupled with the upper jig 311 in which a guide hole (not shown) having the same pattern as the punching blade 312 is formed.

The upper rotation plate 320 penetrates a coupling hole 320*a* in the same shape as the pattern of the punching member 310 so as to enable the punching member 310 to be coupled, and forms a plurality of grooves 321 of the hemisphere shape which are sink inward on a lower surface of the upper rotation plate 320. Further, after a plurality of penetration holes (not shown) are formed on the upper rotation plate 320, a magnet 323 is coupled and formed in the penetration holes.

The upper plate 330 is provided with a plurality of bearings so as to enable the upper rotation plate 320 to be rotated and operated along an inner surface, prevents a separation in case that the upper rotation plate 230 is coupled with the upper plate 330, and is provided with a cover 331 which enables the upper rotation plate 320 to be smoothly rotated. Further, the upper plate 330 is provided with a plurality of magnets 332 at a regular interval along a lower part of the circumference of the upper plate 330.

It is desirable that the magnets 323 and 332 respectively have the polarity opposite to that of a magnet as described below. For example, in case that the magnets 323 and 332 have N-polarity, the mutual position may be set due to a mutual magnetic force by enabling magnets 353 and 362 located in the lower part to have S-polarity. Further, a fixed position may be accurately aligned due to a position correction unit 351.

The lower jig 340 is provided with the same punching hole 341 as shape of specific pattern of the punching member 310.

The lower rotation plate 350 penetrates and forms the coupling hole 350*a*, which enables the lower jig 341 to be coupled, in the same shape as the lower jig 341. In addition, the upper rotation plate 350 is provided with a position correction member 352 in a position opposite to the groove 321 formed on the upper rotation plate 320, and the magnet 353 having the opposite polarity (N-polarity or S-polarity) in a position opposite to the magnet 323.

It is desirable that the position correction member 352 is formed in the same shape as the groove 321 so as to be seated to the groove 321.

For example, as illustrated in FIG. 12, the groove 321 is formed in a hemisphere shape, and the seating groove 352*a* is formed in a position opposite to the groove 321 on an upper surface of the lower rotation plate 350. Then, if the position correction member 352 is inserted and coupled so as to be protruded to an upper part on the seating groove 352*a*, the position correction member 352 may be rotated and operated inside of the seating groove 352*a*.

At this case, the protruded position correction member 352 is practicable to some degree of preventing the separation from the seating groove 352*a*. The punching blade 312 provided on the upper plate 330 and the punching hole 341 provided on the lower plate 360 are firstly set to be in position of the magnets 332 and 362, in which the seat (S) is located in the midst, and is aligned on the mutual fixed position by the position correction member 352 and the groove 321.

Further, the position correction member 352 may make it possible to accurately align the mutual fixed position by the magnetic force of the magnet 324 by providing the magnet 324 on a vertical line of the groove 321.

The lower plate 360 has the same configuration as the upper plate 330, and may be aligned on the mutual fixed position by the upper plate 330 and the magnet 362.

Figure 13:
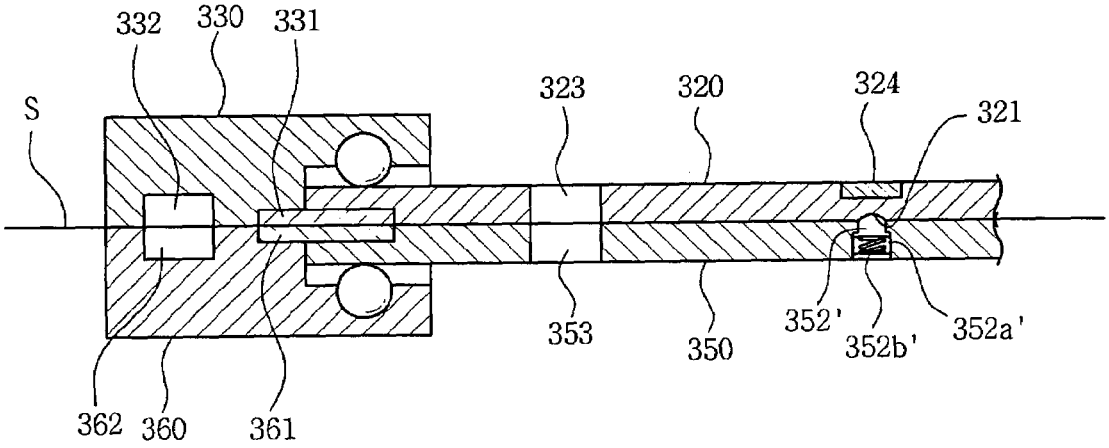
FIG. 13 is a cross-sectional view illustrating the rotary punching apparatus according to a fourth embodiment of the present invention.

FIG. 13 is a cross-sectional view illustrating the rotary punching apparatus according to a fourth embodiment of the present invention.

Referring to FIG. 13, the upper part of a position correction member 352' is formed in a hemisphere shape and a lower part is formed in a warhead of a cylinder shape. In case that the lower part of the position correction member 352' is pressed by an elastic body 351' in a state of being inserted into a seating groove 352*a*', the position correction member 352' is protruded into the upper part of the lower rotation plate 350 and aligned to the groove 321 of the upper rotation plate 320.

The position correction members 352 and 352' may be used of a nonmetal materials or metal materials. Preferably, the metal materials can be used so as to be arrayed by the magnet 324.

Further, the position correction members 352, 352' are composed of magnets and have the polarity crossed to that of the magnet 324, so that the upper rotation plate 320 and the lower rotation plate 350 may be aligned in the fixed position.

Figure 14:
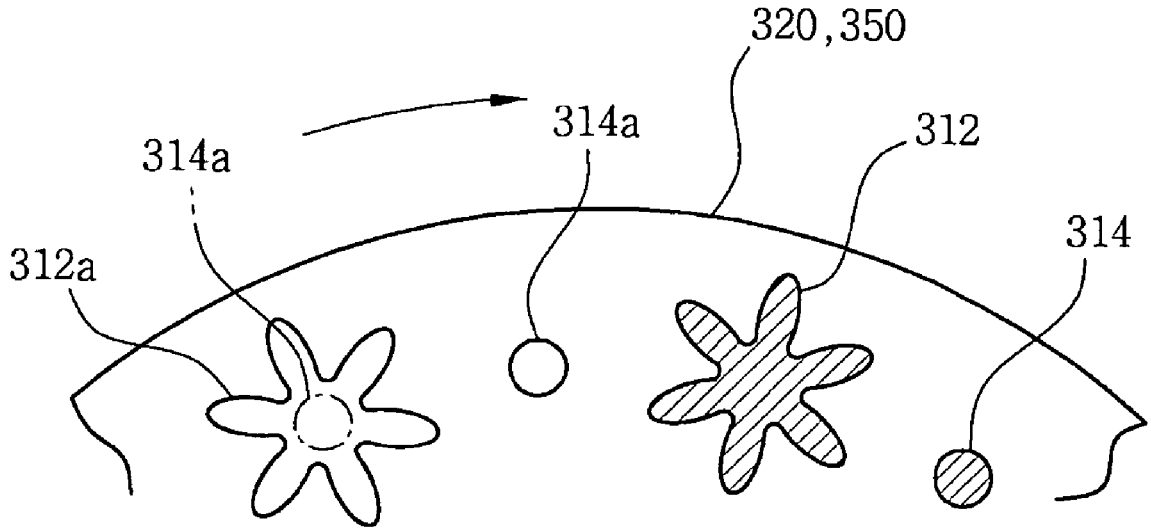
FIG. 14 is a partial expanded plan view illustrating a punching state of a sheet according to the punching apparatus of the present invention.

FIG. 14 is a partial expanded plan view illustrating a punching state of a sheet according to the punching apparatus of the present invention.

As illustrated in FIG. 14, the punching member 310 includes a guide blade 314 located in an outer of the punching blade 312. The pattern of the punching blade 312 is rotated by the upper rotation plate 320 and the lower rotation plate 350 and punched with continuity at a fixed angle. At this time, it is desirable that the guide blade 314 is formed smaller than a punched surface 312*a* so that a punched surface 314*a* can be offset by the punched surface 312*a* punched by the guide blade 314.

Figure 15:
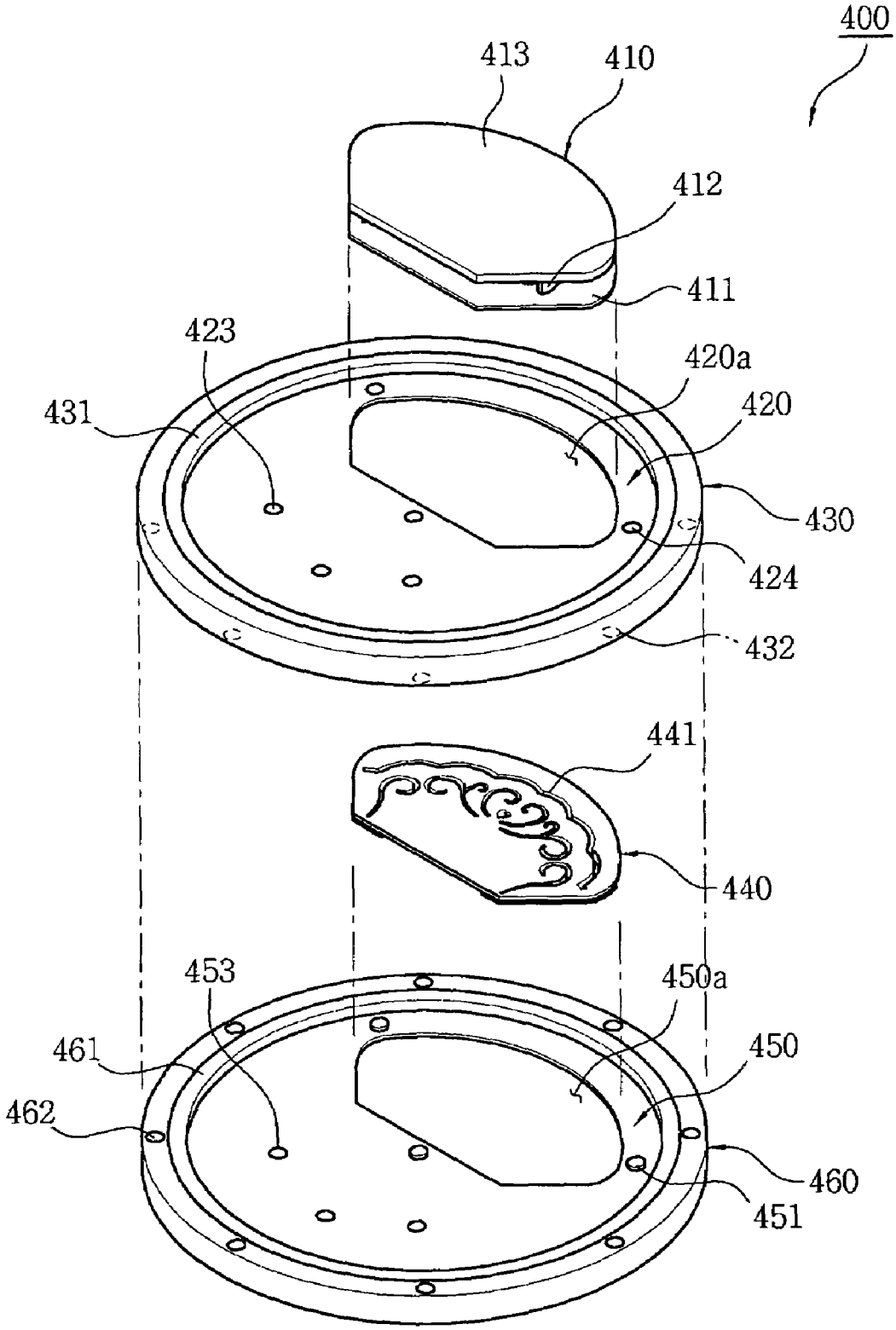
FIG. 15 is an exploded perspective view illustrating the rotary punching apparatus according to a fifth embodiment of the present invention.
Figure 16:
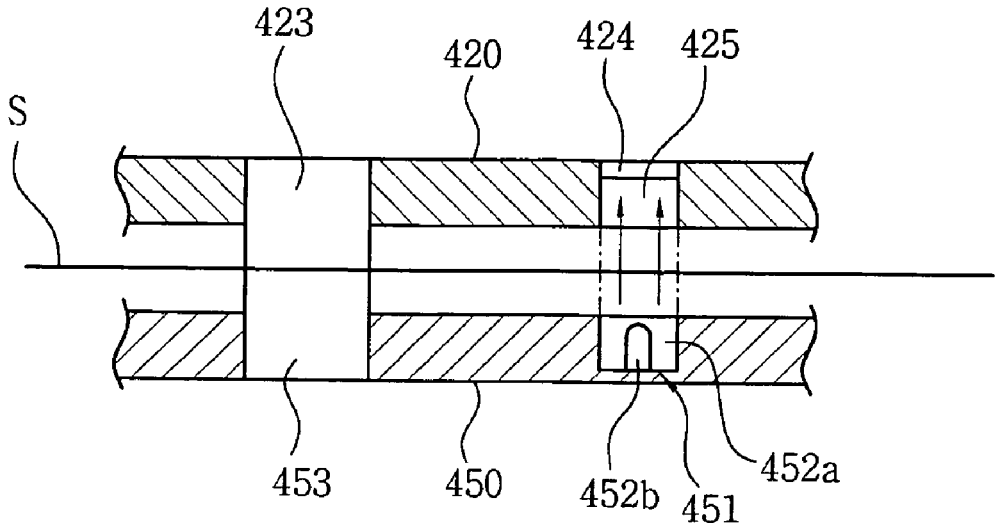
FIG. 16 is a cross-sectional view illustrating an align structure of the rotary punching apparatus illustrated in FIG. 15.
Figure 17:
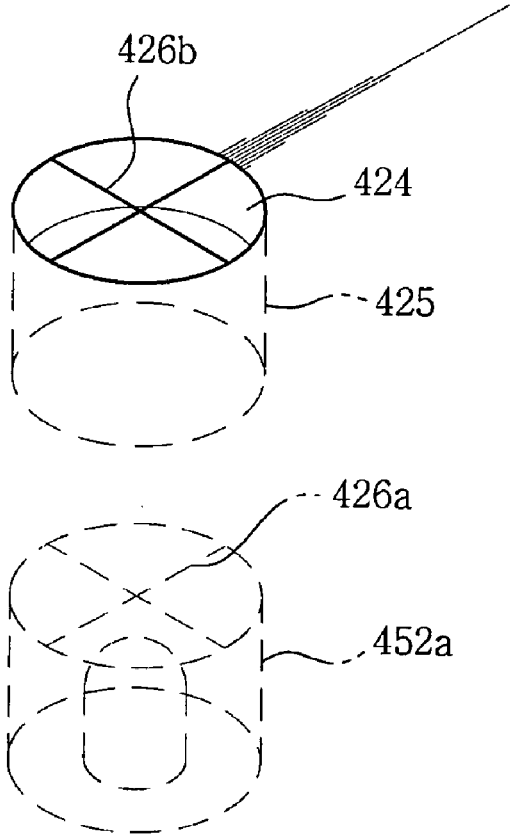
FIG. 17 is a partial expanded cross-sectional view illustrating an align structure of the rotary punching apparatus illustrated in FIG. 16.

FIG. 15 is an exploded perspective view illustrating the rotary punching apparatus according to a fifth embodiment of the present invention, FIG. 16 is a cross-sectional view illustrating an align structure of the rotary punching apparatus illustrated in FIG. 15, and FIG. 17 is a partial expanded cross-sectional view illustrating an align structure of the rotary punching apparatus illustrated in FIG. 16.

Referring to FIGS. 15 to 17, the punching apparatus 400 includes an upper jig 411 on which a pattern of specific shape is formed, a punching member 410 including a pressurization plate 413 which a punching blade 412 is formed in the same shape as the pattern of the upper jig 411, an upper rotation plate 420 configured to enable the punching member to be coupled, and an upper plate 430 configured to enable the upper rotation plate to be rotated and coupled. Further, the punching apparatus 400 includes a lower jig 440 which a punching hole 441 is formed in the same shape as the pattern formed in the punching member 410, a lower rotation plate 450 coupled with the lower jig 440, and a lower plate 460 coupled with the lower rotation plate 450.

The punching member 410 directs downward to the pressurization plate 411 and a lower part of the pressurization plate 411, penetrates and forms the punching blade 412 having a pattern of a specific shape, and is coupled with the upper jig 411 which a guide hole (not shown) having the same pattern as the punching blade 412 is formed.

The upper rotation plate 420 penetrates a coupling hole 420*a* in the same shape as the punching member 410 so that the punching member 410 can be coupled, and includes a plurality of light projection plates 424 located on the upper rotation plate 420. Further, after a plurality of penetration holes (not shown) are formed on the upper rotation plate 420, a magnet 423 is coupled and formed in the penetration holes.

The upper plate 430 is provided with a plurality of bearings so as to enable the upper rotation plate 420 to be rotated along an inner surface, a cover 431 configured to prevent a separation in case that the upper rotation plate 420 is coupled with the upper plate 430 and enable the upper rotation plate 420 to be smoothly rotated, and a plurality of magnets 432 located at a regular interval along a lower part of the circumference of the upper plate 430.

It is desirable that the magnets 423 and 432 respectively have the polarity opposite to that of a magnet as described below. For example, if the magnets 423 and 432 have N-polarity, magnets 453 and 462 located in the lower part have S-polarity, so that the mutual position may be set due to the mutual magnetic force. Further, a fixed position may be accurately aligned by a position correction unit 451.

The lower jig 440 is provided with a punching hole 441 having the same shape as the specific pattern of the punching member 410. Further, the lower rotation plate 450 is provided with a light unit 451 in a position opposite to the light projection plate 424. The light unit 451 includes a seating groove 452*a* and a light source 452*b*. When a light is radiated by inserting and fixing the light source 452*b* to the seating groove 452*a* after the seating groove 452*a* is formed on the lower rotation plate 450, the light is radiated to the upper part through the light projection hole 425 formed on the upper rotation plate 420. At this case, when the light radiated from the seating groove 452*a* by making the size of the seating groove 452*a* and the light projection hole 425 the same is transmitted, a shadow of the seating groove 452*a* is projected on the seat (S). In case that the projected shadow is identified with the light projection hole 425 using the light projection plate 424 of the light projection hole 425, the upper rotation plate 420 and the lower rotation plate 450 may be aligned in a fixed position.

Further, a more accurate align effect may be obtained by forming mixed lines 426*a* and 426*b* which two lines are crossed each other on the seating groove 452*a* and the light projection plate 424.

The light source 452*b* may use anything that can be distinguished on the light projection plate 424 by projecting a generated light through the seat S. It is desirable to use a lamp.

The present invention has the following effects.

The present invention can freely punch a desired position irrespective of punching positions such as the seat as an object of the punching.

The present invention can accurately align in the mutual fixed position due to the magnetic force of a magnet by attaching a plurality of magnets to a position respectively opposite to the upper and the lower plate, the upper the lower rotation plate.

The present invention can perform a continuous works by rotating a rotation plate in case of punching the shape on a sheet by locating the sheet between the upper and the lower rotation plate.

The present invention can accurately punch the pattern of the shape which is punched on the sheet by providing a plurality of guide units on the upper and the lower plate, the upper and the lower rotation plate.

The present invention can increase the compatibility of a product by replacing the upper jig and/or the lower jig corresponding that a pattern of the punching member is changed by enabling the upper jig and/or the lower jig to be attached/detached.

The present invention can more accurately punch the pattern of the shape which is punched on the sheet by locating a magnet on the upper and the lower plate and simultaneously providing a plurality of position correction members on the upper and the lower rotation plate.

The present invention can perform a continuous works on the shape by rotating a rotation plate in case that the shape is punched on the sheet by locating the sheet between the upper and the lower rotation plate.

The present invention can make the punched surface of the pattern uniform by offsetting the punched surface formed by the guide blade with the continuous punching of the punching blade.

While the example embodiments of the present invention and their advantages have been described in detail, it should be understood that various changes, substitutions and alterations may be made herein without departing from the scope of the invention.

What is claimed is:

1. A rotary punching apparatus comprising:

an upper rotation plate having a punching member on which a punching blade having a pattern of a specific shape is formed and an upper jig which elastically support the punching member and on which a guide hole of the same shape as the pattern is formed;

an upper plate configured to enable the upper rotation plate to be rotated;

a lower rotation plate including a lower jig on which a punching hole in the same shape as the pattern is formed; and a lower plate configured to enable the lower rotation plate to be rotated, wherein the upper and the lower plate are provided with at least one magnets in a position opposite to each other, and the upper and the lower rotation plate are provided with at least one or more magnets in a position opposite to each other, so that the fixed position is mutually aligned due to the magnetic force of the magnet.

2. The rotary punching apparatus of claim 1, wherein the upper rotation plate further comprises at least one rotation units which is rotatably coupled to the upper plate.

3. The rotary punching apparatus of claim 2, wherein the rotation unit includes a ball bearing or a roller bearing.

* * * * *